United States Patent [19]

Aubrey et al.

[11] Patent Number: 4,956,758

[45] Date of Patent: Sep. 11, 1990

[54] LAMP MOUNTING APPARATUS AND METHOD

[75] Inventors: Truman R. Aubrey, Glendale; Steven R. Gerke, Los Angeles, both of Calif.

[73] Assignee: Janice Industries, Los Angeles, Calif.

[21] Appl. No.: 335,554

[22] Filed: Apr. 10, 1989

[51] Int. Cl.[5] ..... F21V 17/06

[52] U.S. Cl. ..... 362/285; 362/368; 362/404; 362/457

[58] Field of Search ..... 362/145, 147, 148, 277, 362/285, 362, 364, 365, 368, 403, 404, 457; 248/343, 27.1

[56] References Cited

U.S. PATENT DOCUMENTS

| | | | |
|---|---|---|---|
| 2,861,121 | 11/1958 | Wolar | 248/343 |
| 3,683,173 | 8/1972 | Guth, Jr. | 362/364 |
| 4,595,969 | 6/1986 | McNair | 362/285 |

*Primary Examiner*—Ira S. Lazarus
*Assistant Examiner*—Sue Hagarman
*Attorney, Agent, or Firm*—G. Donald Weber, Jr.

[57] ABSTRACT

One end of an elongated beaded chain is secured in a screw base with a spring loaded connection. The chain extends downward through a central opening in a cover and in a reflector. The opening in the reflector includes a locking slot into which the chain can be placed. After the screw base is threaded into a conventional socket, the chain is passed through the opening as the reflector is drawn up into the opening for the existing recessed fixture. The fixture includes a trim ring which is placed against the ceiling which surrounds the recessed fixture. The chain is then pulled down against the spring in the screw base, pulled to the side into engagement with the slot portion of the opening, and released. The spring pulls upwardly on the chain and seats the new fixture snugly against the ceiling. The spring provides a small amount of flexibility to adjust for expansion and contraction due to temperature, normal structural vibrations, and the like.

18 Claims, 1 Drawing Sheet

LAMP MOUNTING APPARATUS AND METHOD

BACKGROUND OF THE INVENTION

1. Field of the Invention

This invention is directed to a retrofit light fixture, in general, and to a fixture which is used with recessed fixtures, in particular. Moreover, the invention permits incandescent lights to be replaced with fluorescent lights, high pressure sodium lights or the like without a complete renovation of the electrical construction which exists.

2. Prior Art

Recessed ceiling lighting is a highly desirable and extensively used light source. Typically, in such construction a cylindrical fixture is mounted above the ceiling. The electrical socket is mounted on an adjustable bracket and is vertically adjustable within the cylindrical fixture in order to position the reflector and/or the reflector lamp at the desirable height. Before inserting the reflector lamp into the cylindrical housing and screwing the lamp base into the socket, a trim ring is often added to the housing by means of springs which engage the cylindrical housing.

When the socket is not adjustable, the reflector lamp may be positioned too deep within the cylindrical fixture which produces an undesirable light pattern. Conversely, the lamp may extend downwardly beyond the cylindrical fixture which produces an unsightly arrangement and/or glare. If the bracket is bent, the lamp may be misaligned in the housing, resulting in an unsightly appearance and improper direction of the illumination. In practice, the bracket may be bent and misaligned solely by the weight of the lamp which tends to turn the bracket.

Likewise, in some cases, the socket is fixed in the housing by the manufacturer. Different manufacturers use different depths of socket mounting. Consequently, variations of light or illumination are provided.

Incandescent lamps tend to consume a large amount of power. These lamps have relatively short lives, whereupon frequent replacement thereof adds to the costs of operating recessed ceiling lighting. Thus, there is a substantial advantage to be gained in replacing incandescent lamps with fluorescent lamps. However, prior lamps usings fluorescent tubes have had difficulty in creating a point source effect. For example, circular tubes and linear tubes provide area or line sources which are difficult to focus and which cannot be properly used. Moreover, and perhaps more importantly, a retro-fit to fluorescent lamps has usually required a substantial reconstruction because of the different mounting and connecting features.

The present invention is designed to overcome the drawbacks of the prior art devices by providing self-trimming and self-aligning retro-fit ceiling lamps which are quickly and easily installed. Also, this invention permits surface mounted light fixtures to replace recessed light fixtures without wholesale construction changes.

PRIOR ART STATEMENT

Listed herewith is the most pertinent prior art known to applicants:

U.S. Pat. No. 4,327,402; LIGHT FIXTURE; T. Aubrey. This patent is directed to an adjustable, retro-fit fluorescent light fixture with a telescoping adjustment mechanism.

U.S. Pat. No. 3,660,651; ADJUSTABLE LIGHT FIXTURE; E. Miles, Jr. This patent is directed to an adjustable light fixture using a pair of levered arms to adjust the position of the lamp.

U.S. Pat. No. 4,232,361; ADJUSTABLE LIGHT FIXTURE; J. Kelsall. This patent is directed to an adjustable light fixture with a plurality of resilient tracks for adjusting the position of the light fixture.

U.S. Pat. No. 4,520,436; LAMP APPARATUS; R. McNair et al. This patent is directed to a lamp apparatus which includes a reflector and an integral trim ring.

U.S. Pat. No. 4,595,969; LAMP MOUNTING APPARATUS AND METHOD; R. McNair. This patent is directed to a retro-fit lamp fixutre using a plastic strap with a "gripper" which is connected to and slidable along the strap.

U.S. Pat. No. 4,704,664; LAMP APPARATUS; R. McNair. This patent is directed to substantially the same device as described in U.S. Pat. No. 4,520,436 with the addition of a cover to enclose the ballast and sockets.

U.S. patent application Ser. No., 06/679,281; LAMP APPARATUS; R. McNair. This application is a continuation-in-part application of U.S. Pat. No. 4,704,664 noted-above.

Swiss Patent No. 7241; SUSPENSION DEVICE FOR INCANDESCENT LAMPS; H. Rentzch. This patent is directed to a device for counterbalancing a lamp suspended by a light cord.

Reference is also made to the reference cited in the patents listed above.

SUMMARY OF THE INVENTION

The lighting apparatus of the present invention fits within an opening in a surface, for example, a ceiling of a room. Typically, although not necessarily, a sheet metal container, is positioned behind the opening in the surface. Usually, this housing is cylindrical in shape. However, rectilinear housings are possible. The housing is not a part of this invention, per se. An electrical receptacle, for example a threaded socket (although a bayonet connector, pin-type connector, a quick coupling connector, or any other type of connector or candelebra is contemplated) is positioned within the container and beyond the surface in such a manner that it is accessible through the opening. Typically, but not always, the receptacle is substantially centered beyond the opening.

The present invention comprises an apparatus for supporting a lamp, which is mounted inside a reflector. In one embodiment, the reflector is mounted within the recess behind the opening. In another embodiment, the reflector is surface mounted at the opening. The reflector of the present invention preferably has the general shape of a parabola with a circular outer opening through which light from the lamp is emitted. The reflector includes an inward curved or tapered sidewall which terminates in a closed end which is smaller in diameter than the outer opening of the reflector. The reflector may be of any suitable size and shape, for example, the reflector may be truncated, tapered, conical, rectangular, square or any convenient shape.

In a preferred embodiment, at least one lamp receptacle (which may be any convenient receptacle for receiving and holding the lamp) is mounted adjacent the inner end of the reflector although other mounting locations are contemplated. The receptacle may be mounted in any convenient way such as directly on the reflector or on a device adjacent the reflector so that the lamp is positioned within the reflector. In a preferred embodiment, the lamp is a high-output, low-wattage, long-life single ended fluorescent lamp which extends across and slightly downward in the receptacle so that the light source is substantially centered in the reflector. In another embodiment, the lamp is a high pressure sodium lamp, a metal halide lamp, or any other replacement for an incandescent lamp.

A retrofit light fixture has a reflector with an integrally formed trim ring and fluorescent tube receptacles. One or more ballasts are mounted on an upper surface of the reflector or ballast cover. A cover rests on top of the reflector and encloses the ballasts, receptacles and electrical interconnections.

In a preferred form of the invention, the beaded chain has the distal end thereof connected to a washer or disk. The disk has a larger diameter than the coil spring mounted within the hollow screw base connector. The chain passes through the face of the screw base connector along with the electrical wires which are connected from the contacts of the screw base connector to the lamp receptacle. The chain and electrical wires pass through one or more openings in the reflector and the cover if one is used. The openings in the cover can be of any convenient shape to readily pass the chain and/or the wires. The opening in the reflector is shaped like a keyhole with a large opening and a narrow slot extending from one side thereof. The large opening is adapted to readily pass the chain. However, the slot is adapted to receive and lock the chain between the beads thereof.

One end of an elongated bead chain is secured to a flat disk mounted above a compression spring within the screw shell. The chain extends downward through the spring and through an opening in the cover and an opening in the reflector. After the screw base is threaded into a socket, the fixture is pushed upward into the opening in the ceiling. The chain is pulled down through the opening and against the spring force. The chain is then moved sidewise into locking engagement with the opening in the reflector. The spring compresses or expands depending upon which end thereof is attached to the ball chain. The spring then compresses (or expands if it is attached to the lower end of the spring) thereby drawing the reflector and trim ring tight against the ceiling which surrounds the recessed fixture.

After the chain passes through the large opening, the reflector is pushed into contact with the ceiling or similar surface. The chain is pulled downwardly against the spring action, locked in the narrow slot, and released. The spring pulls the chain and, thus, the reflector upward until the trim ring rests snugly against the surface surrounding the opening through which the lamp apparatus is mounted. The chain may be severed below the locking opening whereby the chain end remains within the reflector.

In a preferred form of the invention, the chain is flexible and is resiliently connected to (but electrically insulated from) the threaded base which is connected to the receptacle or socket. When the chain is locked into the reflector, the spring effects an unstressed resilient pulling of the trim ring against the surface, which is desirable.

To remove the reflector from the ceiling fixture, a separate piece of beaded chain, with the conventional connector device, is joined to the existing chain in the reflector. The chain is disengaged from the slot and the reflector permitted to drop along the chain. The screw base is removed from the socket. The re-insertion of the fixture then repeats the original process. The chain can be cut again or merely disconnected at the connector device.

DESCRIPTIONOF THE PREFERRED EMBODIMENTS

Figure 1:
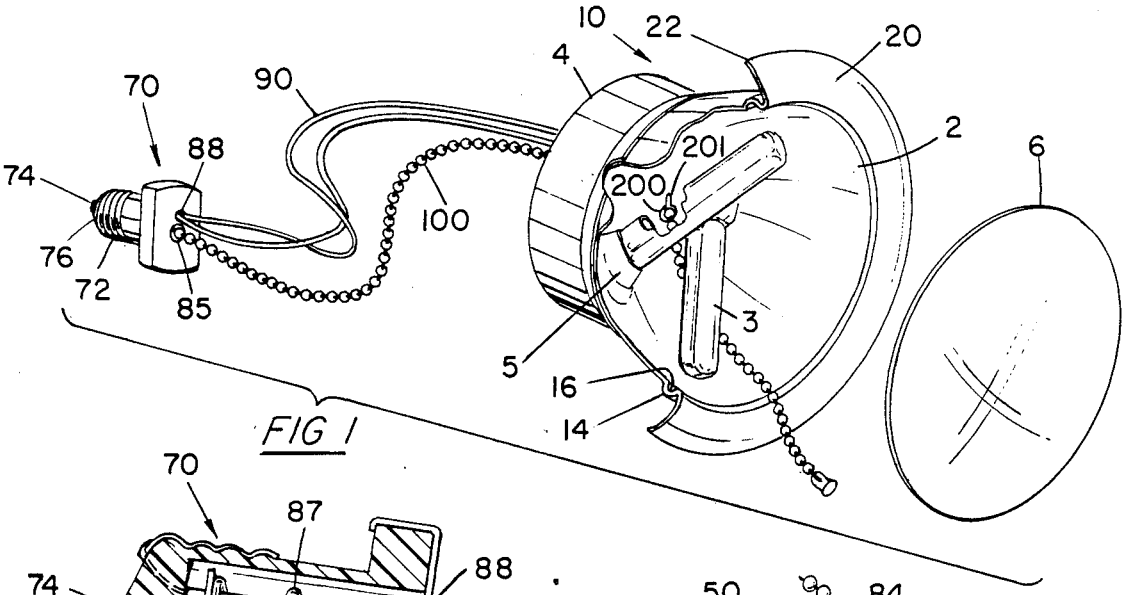
FIG. 1 is a partially broken away, isometric view showing one embodiment of the lamp mounting apparatus of the instant invention.

In the representative embodiment of the invention, similar components with reference to the accompanying drawings, bear similar reference numerals.

Figure 5:
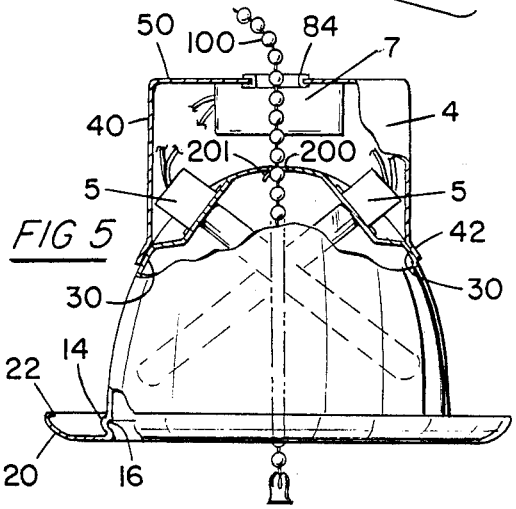
FIG. 5 is a cross-sectional view of the embodiment of the invention shown in FIG. 1.
Figure 2:
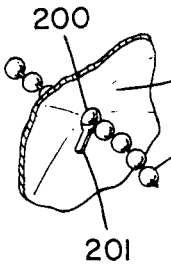
FIG. 2 is a detailed view of the beaded chain and the slotted opening in the reflector or base portion of the lamp mounting apparatus.

Referring now concurrently to FIGS. 1, 2 and 5, the lamp mounting apparatus or fixture 10 includes a reflector 2, a cover 4 and a lens 6. At least one light source 3 is mounted within the reflector 2 so that light shines through the lens 6 when the lamp is energized.

In a preferred embodiment, fluorescent light sources are utilized. Receptacles 5 for fluorescent tubes are mounted in an upper portion of the reflector 2. A ballast 7 (see FIG. 5) is, typically, mounted on the under side of the cover 4. The reflector 2 causes the light to shine downwardly. The fixture 10 fits within a conventional recessed ceiling fitting (not shown). Shoulder 14 and detent 16 hold lens 6 in place. An integral trim ring 20 extends outward to an outer edge 22 which rests against a ceiling (or similar surface) when the lamp apparatus 10 is pulled upward.

A shoulder 30 near the upper portion of the reflector 2 engages the lower edge 42 of the vertical wall 40 of the cover 4 to insure alignment of the cover 4 and reflector 2. An upper surface 50 of the cover 4 is generally flat. The cover 4 and reflector 2 are assembled in any suitable fashion such as bolts and nuts, rivets, welding, or the like. A bushing 84 of rubber or other suitable material is provided in the central opening of the cover 4. Bushing 84 in the flattened portion 50 of the cover 4 protects wires 90 against chafing. The wires 90 are connected to the respective ballasts and receptacles mounted within cover 4. Wires 90 have sufficient length so that, when installed, the apparatus 10 is not supported by the wires, per se, but only by the beaded chain 100. That is, the fixture weight always rests upon the chain means 100 (or the installer) when it is in its lowered position.

A screw base 70 for connecting with an electrical receptacle (not shown) within the recessed lighting fixture has an outer connector 72 and an inner connector 74 separated by insulating material 76, as is conventional.

Figure 3:
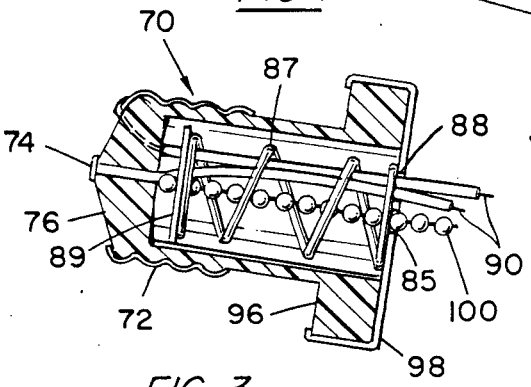
FIG. 3 is a broken away view of the spring loaded screw base of the instant invention.

Referring to FIG. 3, it is seen that screw base 70 has a hollow base 96 with a plate 98 affixed thereto. The plate 98 includes apertures 85 and 88 through which the support means, e.g. chain 100, and wires 90 pass, respectively. A coil spring 87 is mounted within the hollow base 96 and rests upon plate 98. A washer-like disk 89 is disposed over the inner end of spring 87. One end of chain 100 is fixed to disk 89 in any suitable fashion. Disk 89 has an outer dimension (diameter) sufficient to overlie the end of spring 87. Thus, one end of the chain 100 is resiliently retained within screw base 70.

The support means 100 is constructed of a conventional beaded chain. The chain 100 passes through central opening 85 in the bottom plate 98 of the screw base. The chain also passes through an opening in the cover 4 and through the opening 200 in reflector 2. Washer 89 loosely rides on the spring 87.

In the desired installation process, the power is turned off and the existing incandescent reflector lamp is removed along with the spring mounted trim ring or baffle. Lamp centering tabs, adjustable brackets, and the like are remover or relocated out of the way. The light apparatus 10 is supported in any suitable fashion, preferably putting no strain on the wires 90. The screw base 70 is screwed into in the fixture socket (not shown). The lamp apparatus 10 is lifted into the ceiling recess and the trim ring 20 is pushed against the ceiling to make sure that the apparatus fits. Once a correct fit has been assured with trim ring 20 snug against the ceiling, the chain 100 is pulled downwardly (through opening 200) against the force of spring 87. Typically, the chain is pulled downwardly by a distance equal to about two beads of the chain. The chain 100 is then moved sidewise until it engages the slot 210 in the opening 200 in reflector 2. The chain is then released whereupon the spring 87 exerts an upward force, via chain 100, thereby raising the lamp apparatus 10 and maintaining the trim ring 20 in contact with the surface in which the lamp apparatus is mounted.

A wire cutter or the like can be used to remove the lower portion of the chain 100 about one inch below the opening 200. A smooth rod, a plastic strap, or the like, may replace the chain and may be used in conjunction with spring 87. The appropriate lamps 3 are then inserted into the receptacles 5 and the apparatus is ready for operation.

If the lamp apparatus needs to be lowered for any reason, an additional piece of chain 100 can be connected to the last bead of the chain 100 so rethreading of the chain through the opening 200 in reflector 2 is expedited. The existing chain 100 in the screw base 70 need not be replaced, per se.

While a beaded chain is preferred the advantages of the present invention may be realized by using a toothed strap of the type described in the McNair U.S. Pat. No. 4,595,969 noted above or a smooth strip and a fastener formed of sheet metal or the like can be used with the resilient screw base 70 of the instant invention. While these constructions are contemplated, they are deemed inferior to the apparatus described herein.

While the chain 100 may be made of conventional metal beaded chain, any suitable material is possible. For example, nylon or other plastic material is suitable for many applications. However, the material must be able to withstand the modest heat generated by the lamps within the lamp apparatus 10.

Figure 4:
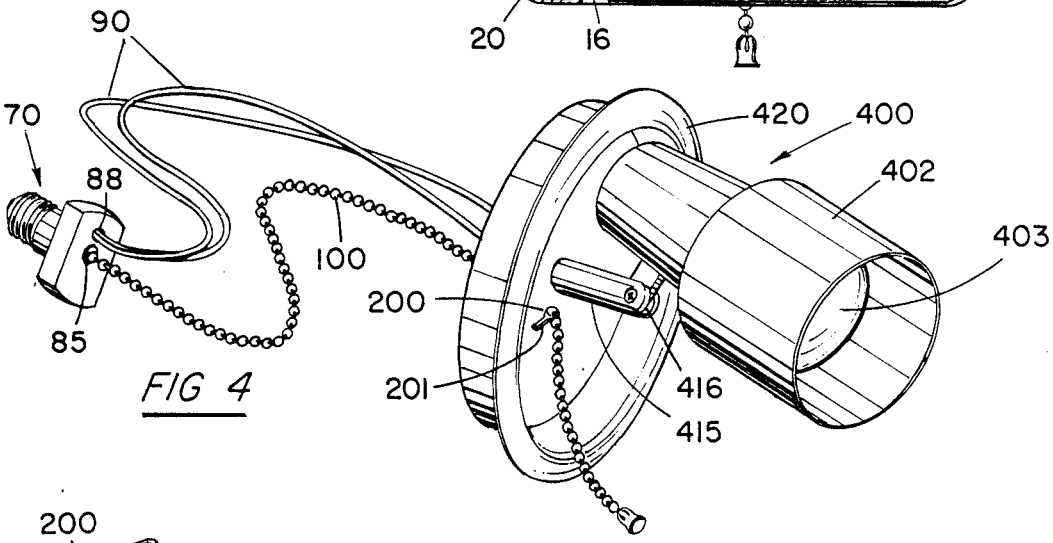
FIG. 4 is an isometric view showing another embodiment of the lamp mounting apparatus of the instant invention.

Referring now to FIG. 4, there is shown another embodiment of the instant invention. In this embodiment, the apparatus 40 includes a relatively shallow base 400 which fits within the opening in the ceiling. The trim ring 20 is adapted to rest against the ceiling surface. The screw base 70, wires 90 and chain 100 operate substantially the same as the components in FIG. 1. However, in this embodiment, the reflector 402 is mounted on a suitable stand off 415 which includes a hinge or swivel joint 416. The stand-off which can be hollow and passes through base 400 from the under side is fixed to base 400 by means of a nut (not shown). A suitable lamp 403 or the like is mounted in reflector 402. The wires 90 can pass through stand-off 415 or through a bushing or grommet (not shown) in the base 400.

This apparatus is installed in the same manner as the apparatus of FIG. 1. That is, the screw base 70 is inserted into a receptacle, the chain 100 is passed through the opening 200 and pulled down. The chain is then locked in the slot 210 and the excess chain is trimmed off.

Thus, the specific embodiments shown and described herein are intended to be illustrative only, and are not intended to be limitative. Rather, the scope of the invention is limited only by the claims appended hereto.

We claim:

1. A lamp mounting apparatus comprising:
electrical connector means;
support means for supporting at least one lamp receptacle;
said support means having at least one aperture therethrough; and
elongated means connected to said electrical connector means and extending through said aperture in said support means;
said aperture arranged to selectively engage said elongated means to prevent movement of said elongated means relative to said support means.

2. The apparatus of claim 1 wherein,
said elongated means comprises a single elongated beaded chain; and
said aperture includes an opening in said support means for readily passing said chain therethrough and a slot extending from said opening which slot selectively engages said beaded chain.

3. The apparatus of claim 1 wherein,
said elongated means has a first end which is anchored in said electrical connector means.

4. The apparatus of claim 1 wherein,
said elongated means is a flexible means having a plurality of enlarged portions.

5. The apparatus recited in claim 1 wherein,
said lamp receptacle is centrally located in said support means.

6. The lamp mounting apparatus recited in claim 1 wherein,
said an electrical connector means has a hollow body; and
resilient means mounted within said hollow body;
said elongated means mounted at one end of said resilient means so that said elongated means is resiliently mounted relative to said electrical connector means.

7. The lamp mounting apparatus recited in claim 6 wherein,
said resilient means comprises spring means.

8. The lamp mounting apparatus recited in claim 7 wherein,
said spring means comprises a coil spring.

9. The lamp mounting apparatus recited in claim 1 wherein, said lamp receptacle is adapted to receive fluorescent lamps.

10. The lamp mounting apparatus recited in claim 1 wherein, said support means includes a reflector means.

11. The lamp mounting apparatus recited in claim 10 wherein, said reflector means is conical in shape.

12. The apparatus recited in claim 2 wherein, said opening is centrally located in said support means.

13. A lamp apparatus apparatus comprising:

an elongated flexible support means including a plurality of enlarged portions joined together at relatively smaller, interstitial portions;

said support means having distal and proximal ends;

means for mounting the distal end of said support means to a lamp fixture; and means for permitting said support means to selectively pass through a lamp mounting apparatus and selectively interlockingly engage said lamp mounting apparatus in order to prevent said lamp mounting apparatus from moving relative to said elongated mounting means.

14. The apparatus of claim 13 wherein, said distal end of said elongated support means is secured to said screw base connector which is adapted for engaging a socket in a light fixture.

15. The lamp mounting apparatus recited in claim 13 wherein, said means for mounting comprises a screw base connector.

16. The lamp mounting apparatus recited in claim 14 including resilient means in said screw base connector to which said distal end of said elongated support means is secured.

17. A method of mounting a light apparatus in a recessed ceiling fixture comprising:

passing an elongated retention means through a reflector means in the light apparatus, connecting a distal end of the elongated retention means to a remote position in the ceiling fixture, positioning said reflector means in a desired position, interlocking said elongated retention means with said reflector means to maintain said reflector means in the desired position, and removing a proximal portion of the elongated retention means between the reflector and the proximal end of the elongated retention means.

18. The method of claim 17 further comprising:

connecting the distal end of the elongated retention means to a screw base and connecting the screw base to a socket remotely positioned within the ceiling fixture and supporting the reflector means on the elongated retention means near a proximal end thereof.

* * * * *